United States Patent [19]

Quercetti

[11] Patent Number: 4,662,846

[45] Date of Patent: May 5, 1987

[54] APPARATUS FOR MECHANICALLY COMPOSING A MOSAIC PATTERN OF BALLS

[76] Inventor: Alessandro Quercetti, Strada San Vito Revigliasco 48, I-10133 Torino, Italy

[21] Appl. No.: 818,597

[22] Filed: Jan. 3, 1986

[30] Foreign Application Priority Data

Jan. 25, 1985 [IT] Italy ..... 67065 A/85

[51] Int. Cl.[4] ..... G09B 19/00; A63D 3/02

[52] U.S. Cl. ..... 434/96; 434/189; 273/122 R

[58] Field of Search ..... 273/119 R, 120 R, 122 R, 273/121 R; 434/189, 208, 96

[56] References Cited

U.S. PATENT DOCUMENTS

| | | | |
|---|---|---|---|
| 1,533,854 | 4/1925 | Gray | 273/122 R |
| 2,782,037 | 2/1957 | Rovira | 273/122 R |
| 2,863,667 | 12/1958 | Batts | 273/122 R |
| 3,278,187 | 10/1966 | Sinden | 273/118 R |
| 3,388,483 | 6/1968 | Weisbecker | 273/118 R |
| 3,390,471 | 7/1968 | Godfrey | 273/118 R |
| 3,807,737 | 4/1974 | Breslow | 273/122 R |
| 3,853,318 | 12/1974 | Cagan | 273/122 R |
| 3,994,076 | 11/1976 | Bertman | 434/189 |
| 4,474,558 | 10/1984 | Quercetti | 273/118 R |

*Primary Examiner*—Richard C. Pinkham
*Assistant Examiner*—Gary Jackson
*Attorney, Agent, or Firm*—Young & Thompson

[57] ABSTRACT

An apparatus for mechanically composing a mosaic pattern formed by balls, which comprises an inclined composition table subdivided by uniformly spaced protruding guides into a number of columns extending along the direction of the lines of maximum slope, each column having a width slightly larger than the diameter of a ball and a length several times larger than said diameter, a store of differently colored balls to be disposed into columns, situated at a level higher than that of the composition table, a reservoir for discharged balls, situated at a level lower then that of the composition table, a launching and column forming device actuable to direct each ball arriving from the upper store towards a preselected column of the composition table, a rejection device opening into the lower reservoir, a retaining device situated at the lower end of the columns of the composition table to normally retain the balls contained in these columns and, on command, to let them roll down towards the lower reservoir, and a passage for the transfer of balls from the lower reservoir to the upper store.

19 Claims, 8 Drawing Figures

APPARATUS FOR MECHANICALLY COMPOSING A MOSAIC PATTERN OF BALLS

BACKGROUND OF THE INVENTION

This invention relates to an apparatus for mechanically composing a mosaic pattern formed by balls.

Games consisting of sets of differently coloured balls, intended to be disposed on a usually perforated composition table in order to form mosaic patterns thereon, are well known and widely used. Up to this time, however, the compositions had to be carried out manually by selecting the desired balls the one after the other from a box and then suitably disposing the same onto a composition table.

SUMMARY OF THE INVENTION

It is an object of this invention to give new attraction features to the referred type of game, by providing an apparatus intended to allow the composition of mosaic patterns to be carried out with the aid of mechanical means for the selection of the balls to be inserted and their insertion into the preselected locations of the mosaic patterns being formed.

Another object of the invention is to provide an apparatus performing the herinabove described operation, capable of stimulating and developing the readiness of perception, decision and physical reaction of the player.

These objects are attained, according to this invention, by means of an apparatus for mechanically composing mosaic patterns formed by balls, which comprises in combination: an inclined composition table having uniformly spaced protruding guides which subdivide said composition table into a number of columns extending along the direction of the lines of maximum slope of the composition table, each column having a width slightly larger than the diameter of a ball and a length equal to at least several times said diameter; a store of differently coloured balls to be disposed into the columns, situated at a level higher than that of the composition table; a reservoir of discharged balls, situated at a level lower than that of the composition table; a launching device actuable in order to launch each ball arriving from the upper store along a trajectory transversal relative to said columns of the composition table; a column forming device actuable to deviate each launched ball from its transversal trajectory, in register with a preselected column of the composition table, thus introducing said ball into said column; a retaining device situated at the lower end of the columns of said composition table for normally keeping within said columns, one on the other, the balls contained in each column, and neutralizable in order to let said balls descend towards the lower reservoir; a rejection device which opens into the lower reservoir actuable in order to exclude some undesired balls from the formation into columns; and a passageway for the transfer of balls from the lower reservoir to the upper store.

Thanks to these characteristics, the balls which arrive one at a time to the launching device from the upper store, in an orderly manner but with a casual succession of their different colours, may be individually treated by addressing them to one or another column of the composition table, or by excluding them from the composition and directing them to the lower reservoir; and the balls directed towards each column of the composition table result in being disposed one on the other in the same order in which they have been introduced, thus allowing, through a suitable choice of the addressing imparted to the successive balls as a function of their colours, to form on the composition table a desired mosaic pattern.

The casual presentation of the balls of different colours, and the rapidity with which they may be disposed into columns by actuating the launching device and the column forming device, result in being very stimulating for the player, since they require from him a perception of the colour of the ball which presents itself ready for being launched as well as of the colours of the following balls, an evaluation of the column towards which a ball having a particular colour may be directed, or alternatively the opportuneness of rejecting that ball thus excluding the same from the formation into columns, the consequent control of the column forming device and finally the actuation of the launching device, all these operations being performable very rapidly in the correct manner only on the condition that the player is endowed with exactness and readiness of perception, decision and reaction, and with an adequate coordination of his movements, all these qualities becoming competitively developed by the game.

Especially the already experienced player, who has learnt taking into account the order with which the balls pass from the upper store to the launching device, and is therefore in a condition to foresee in which order he will have at his disposal the balls of the different colours, can develop a tactical evaluation of the opportunities of disposing the balls in the various columns to obtain with the minimum number of rejections in the desired pattern, thus attaining even very high composition speeds made possible by the launching rhythm, which may reach, for example, the frequency of 6 balls per second. Moreover, the game advantageously develops the coordination of the movements of both hands, owing to the need for controlling simultaneously, one by each hand, the launching device and the column forming device, respectively. The amusement and the possible competition, resulting from a clever management of the game, advantageously stimulate the development and coordination of the psychomotorial activities of the player.

Preferably, the upper store for the balls is formed by a flat region delimited by a suitably inclined lower wall through which opens a mouth of the launching device, and it has no wall extending convergently relative to said lower wall, so that the balls contained in the upper store rest against each other and against the lowest ball engaged within the launching device, and roll down in an orderly manner one at a time into the launching device without giving rise to cloggings.

Preferably, the column forming device comprises a plurality of deviation means, each of which corresponds to a column of the composition table, and a corresponding plurality of control means, each of which is marked in conformity with that column of the composition table to which the activation of the relevant control means gives access.

BRIEF DESCRIPTION OF THE DRAWINGS

The above and other characteristics and advantages of the invention will be more clearly apparent from the following description of an embodiment, given by way of non limiting example and diagrammatically shown in the annexed drawings, in which.

DETAILED DESCRIPTION OF A PREFERRED EMBODIMENT

Figure 1:
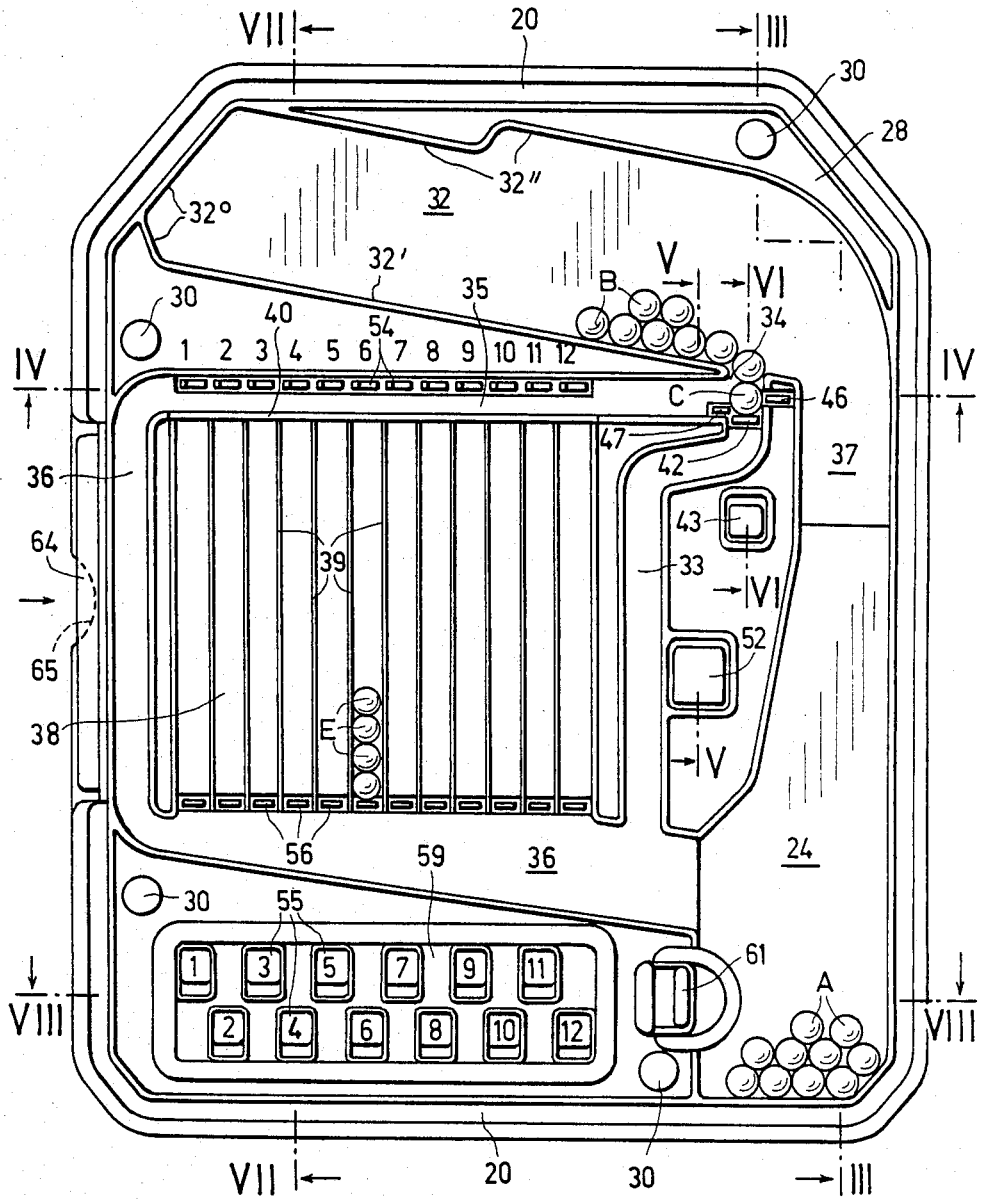
FIG. 1 is a somewhat reduced front view of the apparatus according to the invention.

The apparatus shown in the drawings comprises a box-like body 20 which may be molded of plastics and is frontally closed by a cover 28 of transparent plastics, connected to the body 20, for example, by means of elastic snappy rivets 30. Inserted between the box-like 20 and the transparent cover 28 there is a rigid sheet 31, for example of cardboard cut by means of a hollow punch, which defines a rolling plane for the balls.

Figure 2:
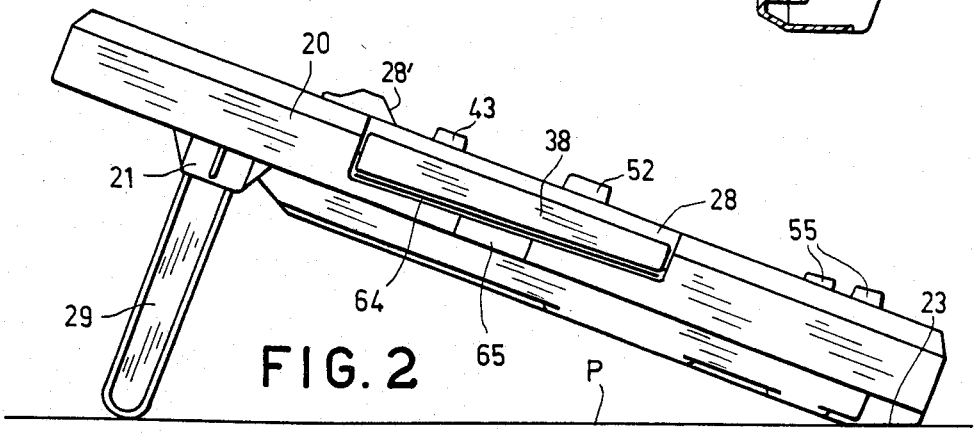
FIG. 2 is a more reduced side view of the apparatus in its condition of use.
Figure 3:
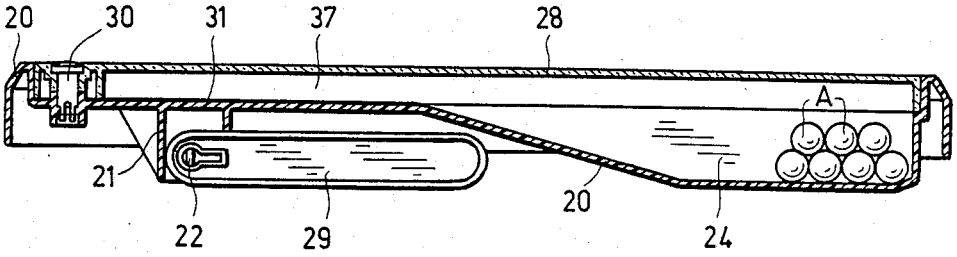
FIG. 3 is a sectional view of the apparatus taken along the broken line III—III of FIG. 1, on a more reduced scale and in the condition suitable for being put away.

The box-like body 20 is dorsally provided with joints 21 to which there are connected legs 29 capable of assuming an activity position and a neutralized position. In the activity position (FIG. 2), the free ends of the legs 29 and the lowest dorsal edge 23 of the body 20 may rest on a plane P, for example of a table, thus maintaining the box-like body 20 in an inclined position to which corresponds the condition of use of the apparatus. The value of the slope is chosen, also as a function of the materials used, so as to generate an appropriate rolling speed of the balls used for the composition. In the neutralized position (FIG. 3), the legs are approached to the body 20 and allow the apparatus to be put away with a reduced encumberment.

In the embodiment shown, the legs 29 are articulated by means of slots on flattened pivots 22 formed on the joints 21, about which the legs can rotate to reach the neutralized position, whereas in the position of activity they can be slightly inserted into the joints 21, thus engaging the flattened pivots 22, whereby they can no more rotate and ensure the bearing stability until they will be pulled towards the outside in order to allow rotating them and bringing them back to the neutralized position.

Mounted within the box-like body 20 there is a composition table 38, preferably made of transparent plastics, which has a series of protruding rectilinear parallel and uniformly spaced guides 39 disposed along the lines of maximum slope of the body 20 when this latter is in the condition of use, and a transversal wall 40 extending at the upper end of the protruding guides 39. These latter subdivide the composition table 38 into a number of parallel columns which have a width slightly larger than the diamter of the balls intended to be used for the formation of the mosaic pattern, and a length corresponding to several times the diameter of said balls.

A lower and lateral portion of the body 20, not covered by the rolling plane 31, forms a lower reservoir 24 for reserve balls A, which are of different colours. The whole thickness of the box-like body 20 is utilized for this reservoir, thus obtaining, yet with a reduced encumberment surface, a reservoir of a sufficient capacity. Protruding walls, formed on the transparent cover 28 at its face turned towards the box-like body 20, delimit on the rolling plane 31 different regions, namely: an upper store 32 for balls B to be disposed into columns, a rejection passageway 33 extending from the upper part of the apparatus up to the lower reservoir 24, a launching passageway 35 which communicates with the lowest point of the upper store 32 through a mouth 34 and extends along the transversal wall 40 of the composition table 38, a return passageway 36 which from the end of the launching passageway 35 descends sideways the composition table, passes along its lower edge and opens into the lower reservoir 24, and finally a wide charging passage 37 connecting the lower reservoir 24 to the upper store 32.

The upper store 32 is delimited by an inclined lower wall 32' through which opens the mouth 34 of the lauching passageway; all the balls B contained in the store rest on the lower wall 32' and on the lower ball engaged in the mouth 34, thus spontaneously arranging themselves in an orderly way in superimposed rows. The store 32 has no delimitation walls towards the charging passage 37, and this characteristic prevents during the feed of the balls any possibility of clogging, which unavoidably would occur with a usual hopper-like configuration. Moreover, the store 32 has wall sections 32'' opposite the lower wall 32', which sections extend along a direction parallel to this latter, and lateral wall sections 32° inclined at 60° with respect to the walls 32' and 32'', so that the outline of the store reproduces the spontaneous arrangement of the balls contained therein, thus utilizing to the maximum degree the space and favouring an orderly arrangement of the balls. In the illustrated embodiment the two wall sections 32'' opposite the lower wall 32' form a step whose height is equal to that of the ball rows, in order to increase the utilization of the space without disturbing the regularity of the arrangement of the balls.

The slope of the lower wall 32' relative to a horizontal line of the rolling plane 31 is chosen, also as a function of the materials used and the slope of the body 20 is the condition of use, in such a manner that the balls B contained in the store 32 will rest the one on another with a sufficient stability, and will tend to roll regularly, row by row, towards the mouth 34 as the balls are withdrawn from the store through said mouth. The slope shown in the drawing is suitable, in the exemplified conditions, when the rolling plane 31 is made of metallized cardboard and the balls are made of plastics.

Figure 6:
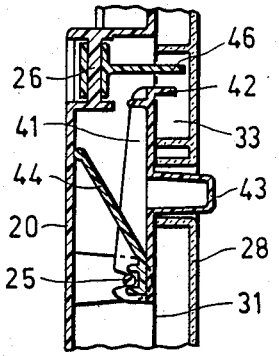

The mouth of the rejection passageway 33 is situated in front of the mouth 34 of the launching passageway 35 and normally it is occluded by a tab 42 formed on a lever 41 (FIG. 6) pivoted on a pivot 25 of the box-like body 20 and provided with a rejection control pushbutton 43. A return spring 44 maintains the lever 41 and its tab 42 in a position occluding the mouth of the discharge passageway 33. The pushbutton 43 projects from the cover 28 and may be pressed in order to temporarily displace the tab 42 so as to stop it from occluding the discharge passageway 33. By this operation the balls B situated in the upper store 32 are allowed to roll by gravity, the one after the other, through the rejection passageway 33 towards the lower reservoir 24, as long as the pushbutton 43 is kept lowered.

Figure 5:
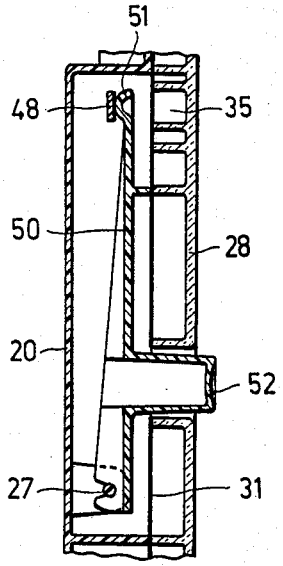
FIGS. 4 to 8 are five sectional views, taken along the lines IV—IV to VIII—VIII, respectively, of FIG. 1, showing some details of the apparatus according to the invention.
Figure 4:
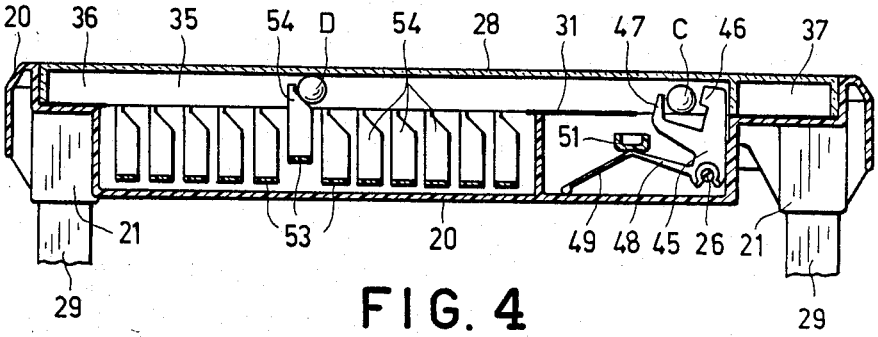

The launching device is installed at the mouth of the launching passageway 35. The launching device comprises a launching member 46 and a retaining member 47, both of them being supported by a lever 45 (FIG. 4) pivoted on a pivot 26 formed on the box-like body 20. Lever 45 has an operation arm 48 which terminates in an elastically flexible member 49 forming a return spring which normally maintains the lever 45 in the position shown in FIG. 4. In this position the members 46 and 47 are positioned at the two sides of the mouth 34 of the launching passageway 35 and retain a ball C which, being situated at the bottom of the upper store 32, has penetrated by gravity into the mouth 34. Resting on the operation arm 48 of the lever 45 there is a tappet end 51 of an operation lever 50 (FIG. 5) pivoted on a pivot 27 formed on the box-like body 20 and provided with a control pushbutton 52. Pushbutton 52 projects from the cover 28 and can be pressed, or rather struck, to lower the lever 50 and thus make oscillate the lever 45 against the action of the spring 49. By this operation the retaining member 47 is made to disappear below the rolling plane 31, whilst the launching member 46 advances and imparts a pulse to the ball C, thus making it roll along the launching passageway 35. If the ball is not intercepted, it reaches the end of the launching passageway 35 and enters the return passageway 36, thus returning along this latter to the lower reservoir 24. This operation serves to exclude from the column formation the balls which are not intended to be used, and furthermore, in this way, the balls which, in consequence of any error whatever, have not been disposed into columns are recovered and reintroduced into the reservoir 24.

Figure 7:
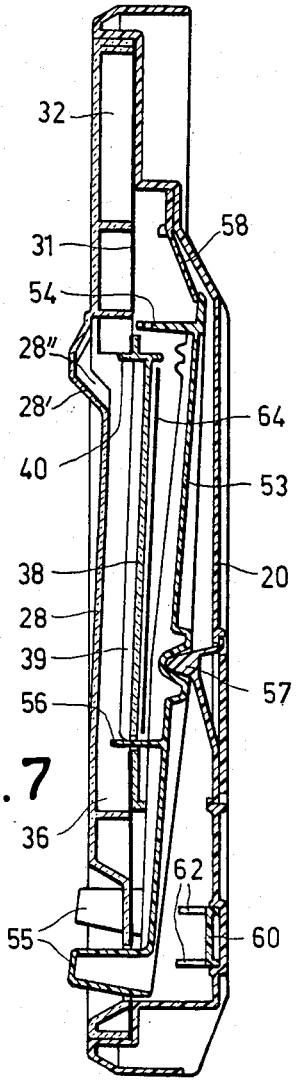

Operation lever 50 acts with a considerable multiplication, so that a short stroke of the pushbutton 52 is sufficient for imparting to the lever 45 a pulse capable of launching the ball. This fact facilitates the use of the apparatus, in consideration of the fact that the pushbutton 52 has to be struck many times during each composition, and also aids launching the balls in a rapid succession The column forming device is located between the composition table 38 and the bottom of the body 20; it comprises a number of column formation levers 53, one for each column of the composition table. Each column formation lever 53 (FIG. 7) is pivoted on an elastically yielding support 57 applied onto the box-like body 20 and is subjected to the action of a return spring 58 which normally retains the lever in the position shown in FIG. 7. Each lever 53 has a deviation tab 54 which, in the rest condition, is situated between the rolling plane 31 and the bottom of the body 20, in register with launching passageway 35 (but without projecting into this passageway), and at a greater distance from the transversal wall 40 of the composition table 38 than from the opposite wall of the passageway 35. Each tab 54 forms an inclined ramp (FIG. 4), and preferably terminates with a tooth. At the opposite end of the tab 54 each column formation lever 53 has a control pushbutton 55. Finally, each column formation lever 53 is provided with a shutter tab 56 which normally projects from the composition table 38 at the lower end of the corresponding column and retains the balls E contained therein, which thus remain aligned one on the other between the protruding guides 39.

All the control pushbuttons 55 of the various column formation levers 53 are disposed as to form a keyboard 59, and they are each marked, for example, by a number from 1 to 12, whilst the same numbers are impressed at the head of the corresponding columns of the composition table 38, in order to facilitate singling out the pushbutton corresponding to each column. The levers 53 have alternatively two different lengths, so that their pushbuttons 55 which form the keyboard 59 are displaced on two levels (FIGS. 1 and 7), and they can be disposed at such a respective spacing as to allow easy fingering.

Figure 8:
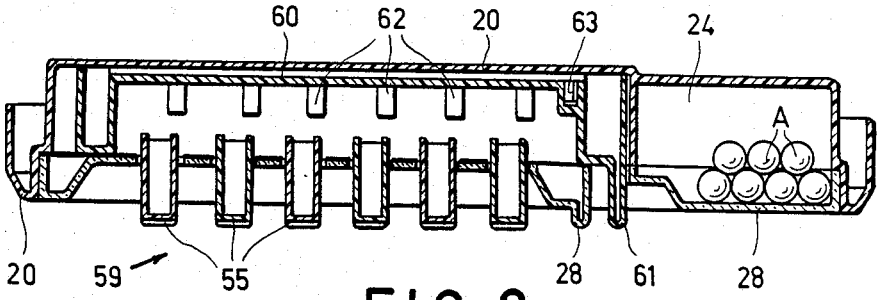

In register with the pushbuttons 55 there is a stroke limiting member 60 (FIGS. 7 and 8), slidable along a transversal direction within the box-like body 20, retained in the position shown in the drawings by means of a return spring 63 and displaceable by means of a control projection 61 protruding from the cover 28. The limiting member 60 is provided with prongs 62 adapted to hold up the pushbottons and, normally, to limit the stroke of these latter to what is sufficient to control the deviation tabs 54. By displacing the limiting member 60, the prongs 62 cease holding up the pushbuttons 55 and limiting their stroke; it is then possible to continue lowering a pushbutton 55 till the shutter tab 56 is made to disappear below the composition table 38. By this operation, the end of a column of the composition table 38 is released, and this column is emptied of the balls E which were contained therein and which descend into the return passageway 36 and collect within the lower reservoir 24.

The apparatus according to this invention is used as follows. A certain quantity of differently coloured balls A is initially contained within the lower reservoir 24. By inclining the apparatus opposite its slope in the condition of use, at least a part of the balls is transferred, through the charging passage 37, to the upper store 32, where these balls B collect in an orderly way by resting on each other, whilst the lowest of them, the ball C, enters the mouth 34 of the launching passageway 35 and remains stationary therein, retained between the tab 42, the launching member 46 and the retaining member 47. The composition starts from this situation.

If the ball C is of an undesired colour, it can be rejected by striking the pushbutton 52 without actuating any column formation pushbutton; in this case, the ball passes through the whole launching passageway 35 and then through the return passageway 36, and returns to the lower reservoir 24. If more balls have to be rejected, the above operation may be repeated more times or, alternatively, the pushbutton 43 may be pressed to render temporarily accessible the rejection passage 33.

If, on the contrary, in the position C there is a ball which is intended to be located in a certain column of the composition table 38, the pushbutton 55 which corresponds to the chosen column is pressed and, by keeping said pushbutton in the pressed condition, also the pushbutton 52 is struck; then the ball is launched into the launching passageway 35, but it meets with the raised deviation tab 54; the ball D climbs the ramp of this tab and, by rising on the side opposite the wall 40 of the composition table 38, may thus override said wall and fall into the selected column of the composition table, then stopping against the shutter tab 56 or against the other balls already contained in the same column. The end tooth of the deviation tab 54 ensures a suitable deviation of the ball in those cases in which some uncertainties of in the deviation could arise.

In order to allow the balls to override the wall 40 and then compel them to insert themselves between the guides 39 of the selected column, the cover 28 has, in register with the launching passageway 35, a raised portion delimited by an inclined wall 28'. Preferably, this latter has also, in successive sections each corresponding to one of the columns of the composition table 38, a transversal slope which serves to make the deviated ball rebound towards the corresponding column. Furthermore, the cover has wall sections 28'' directed towards the corresponding protruding guides 39, in order to completely separate the various columns also in register with the raised portion of the cover. In its portion which covers the composition table 38, the cover 28 extends parallel to the composition table at a distance therefrom which is slightly larger than the diameter of the balls used. Thanks to the whole of these provisions, both the slowly launched and the more rapid balls are directed, without any uncertainty, towards the selected columns.

By repeating the process described hereinabove and by suitably selecting each time the activated column formation pushbutton, it is possible to direct to the various columns of the composition table, in the desired order, the balls having the selected colours, thus composing on the table 38 a mosaic of balls which form the desired pattern.

In case of error, the column in which the error has occurred may be emptied by actuating the corresponding pushbutton 55 after having displaced, by means of the control projection 61, the limiting member 60, and then making disappear below the rolling plane 31 the shutter tab 56 corresponding to the column to be emptied.

In order to facilitate the composition, especially as long as the person using the apparatus is not yet familiar with this latter, a card 64 showing a previously prepared pattern may be inserted into a corresponding slot provided between the composition table 38 and the bottom of the body 20. The card 64 can be seen through the composition table 38, which, as already said, is transparent, and guides the composition of the balls in conformity with the pattern, thus rendering said composition much easier to be carried out. To allow then an easier withdrawal of the card 64, a cavity 65 is formed in the corresponding portion of the body 20.

Should the balls 8 contained in the upper store 32 not be sufficient to complete the composition, other balls may be moved from the position A to the position B, by inclining the apparatus again opposite its slope in the condition of use. This does not involve the destroying the composition already carried out, because during this operation the balls contained in the columns of the composition table 38 are stopped by the transversal wall 40 and cannot leave the respective columns. To allow providing, in register with the wall 40, a sufficiently high step which surely could not be overridden by the balls, the composition table 38 is arranged with a slope slightly lesser than that of the rolling plane 31, as it can be seen in FIG. 7.

At the end of the composition, the upper store 32 may be rapidly emptied by actuating the pushbutton 43 and thus clearing the passage to the rejection passageway 33.

Of course, various constructive modifications may be made to the embodiment described hereinabove by way of example. For instance, the legs 29 may be constructively separated from the body 20 and be applied thereon for the use of the apparatus and detached therefrom for being put away. Devices different from those described herein could be used for launching the balls, for deviating them towards the columns in which they have to be disposed and for rejecting the undesired balls. The emptying of the columns could be controlled by means of pushbuttons separated from the column formation pushbuttons.

I claim:

1. An apparatus for mechanically composing a mosaic pattern formed by balls, comprising an inclined composition table having uniformly spaced protruding guides, said guides subdividing said composition table into a number of columns extending along the direction of the slope of said composition table, each column having a width slightly larger than the diameter of said balls and a length equal to at least several times said diameter; a store for differently coloured balls to be disposed into said columns, said store being situated at a level higher than that of said composition table; a reservoir for discharged balls, situated at a level lower that of said composition table; a launching device actuable to launch each ball arriving from the upper store, along a trajectory transversal relative to said columns of the composition table; a column forming device actuable to deviate each launched ball from its transversal trajectory, in register with a preselected column of said composition table, thus introducing said deviated ball into said preselected column; a retaining device situated at a lower end of the columns of said composition table for normally keeping, resting the one on the other, the balls contained in each column, and neutralizable to let said balls descend towards said lower reservoir; a rejection device having a rejection passageway which opens into said lower reservoir, actuable to exclude from the formation into columns some undesired balls; and a passageway for the transfer of balls from said lower reservoir to said upper store.

2. An apparatus as claimed in claim 1, wherein said upper store for balls comprises a plane region having a delimiting inclined lower wall, said launching device has a mouth which opens through said inclined lower wall of the upper store, and said upper store is free from any wall convergent towards said inclined lower wall, the balls contained in said upper store resting against the one another and agaist a lowest ball engaged in said mouth of the launching device.

3. An apparatus as claimed in claim 2, wherein said upper store for balls further has delimiting upper wall sections parallel to said inclined lower wall, and sidewall sections situated on one side only and inclined by angles of nearly 60° relative to said lower and upper walls.

4. An apparatus as claimed in claim 2, wherein said launching device comprises a lever including a launching member and a retaining member which, in their rest position, are situated at both sides of said mouth of the launching device, said lever further having an elastic return means, and said launching device further comprises a control pushbutton and a transmission means connecting said pushbutton to said lever with a considerable multiplication ratio of the displacement.

5. An apparatus as claimed in claim 1, wherein said composition table has a transversal wall, situated at the upper end of said protruding guides, and a launching passageway defined by said transversal wall, said launching device operating along said launching passageway.

6. An apparatus as claimed in claim 5, wherein said body has a bottom, said column formation device comprises a number of deviation tabs which in the rest condition are situated between said launching passageway and said bottom of the body and do not project into said launching passageway, each deviation tab corresponding to a column of the composition table, and a number of control means, each corresponding to one of said deviation tabs and each of which is marked as corresponding to a respective column of the composition table, and is operatively connected to the corresponding deviation tab in order to make it project into said launching passageway when the control pushbutton is activated.

7. An apparatus as claimed in claim 6, wherein said launching passageway has a wall opposite said transversal wall of the composition table, each said deviation tab is situated, with respect to the launching passageway, at a greater distance from said transversal wall of the composition table than from said wall of the passageway opposite said transversal wall, and each of said tabs has a inclined ramp capable of lifting a ball launched along the launching passageway, thus making it override said transversal wall and deviating it into the corresponding column of the composition table.

8. An apparatus as claimed in claim 7, wherein each said deviation tab has a tooth at the end of said inclined ramp.

9. An apparatus as claimed in claim 7, comprising a number of column forming levers, each said column forming lever being rigidly connected to one of said deviation tabs and to the corresponding control pushbutton, and having a retaining tab which forms the retaining device for the corresponding column of the composition table, said retaining tab remaining active when the control pushbutton is pressed to an extent sufficient to lift the deviation tab, but being neutralized in consequence of a longer stroke of said control pushbutton.

10. An apparatus as claimed in claim 9, wherein a limiting member is disposed in register with all said column forming levers to limit their stroke, thus normally preventing the neutralization of said retaining tabs, said limiting member being displaceable when needed into an inactive position in which it ceases limiting the stroke of the column forming levers and allows neutralization of said retaining tabs.

11. An apparatus as claimed in claim 5, further comprising a return passageway, which begins from that end of said launching passageway which is opposite the launching device, passes along the lower edge of said composition table and along said retaining device and opens into said lower reservoir.

12. An apparatus as claimed in claim 1, wherein said rejection passageway begins at a point in register with said launching device, and said rejection device comprises a tab normally occluding said rejection passageway and a rejection control pushbutton connected to said tab in order to allow to displace said tab to a neutralized position.

13. An apparatus as claimed in claim 1, wherein said composition table is transparent and a space is provided between said composition table and the bottom of the body, and further comprising at least one card showing a pattern intended to guide the composition, said care being insertable into said space under said transparent composition table.

14. An apparatus as claimed in claim 1, which comprises a box-like body made of plastics, a transparent cover, and between said body and said cover a sheet member forming a rolling plane for the balls, and wherein said transparent cover has on its face turned towards the box-like body some protruding walls which subdivide said rolling plane into different operative regions.

15. An apparatus as claimed in claim 14, wherein said cover has a raised portion in register with said transversal launching trajectory for the balls, said raised portion having inclined and oriented surface sections corresponding to the parts of said deviation device and to the columns of said composition table.

16. An apparatus as claimed in claim 14, wherein said cover has near said launching passageway, protruding wall sections corresponding to the protruding guides of said composition table and directed towards said protruding guides.

17. An apparatus as claimed in claim 14, wherein said cover, in a portion corresponding to said composition table, extends parallel to said composition table at a distance therefrom which is slightly greater than the diameter of said balls.

18. An apparatus as claimed in claim 14, wherein said box-like body has removable or displaceable legs arranged to keep said body in an inclined position in the condition of use, and to allow putting away said body with reduced encumbrance.

19. An apparatus as claimed in claim 1, wherein said inclined composition table has a slope lesser than the general slope of the apparatus, and has at its upper end a step which cannot be overridden by the balls when the inclination of the apparatus is inverted in order to displace the balls from said lower reservoir to said upper store.

* * * * *